United States Patent [19]

Hsu

[11] Patent Number: 5,012,611

[45] Date of Patent: May 7, 1991

[54] SEALING MECHANISM FOR A WINDOW SET

[75] Inventor: James Hsu, Taipei, Taiwan

[73] Assignee: Lava Group Inc., Taipei, Taiwan

[21] Appl. No.: 555,322

[22] Filed: Jul. 19, 1990

[51] Int. Cl.[5] ..... E05D 13/00

[52] U.S. Cl. ..... 49/225

[58] Field of Search ..... 49/209, 225, 316, 317, 49/320, 321

[56] References Cited

U.S. PATENT DOCUMENTS

| | | | |
|---|---|---|---|
| 412,430 | 10/1889 | Swab | 49/320 |
| 968,775 | 8/1910 | Langefeld | 49/316 |
| 1,538,888 | 5/1925 | Colton | 49/321 |
| 4,341,043 | 7/1982 | Yamamoto et al. | 49/209 X |
| 4,432,164 | 2/1984 | Baguet | 49/209 |
| 4,562,667 | 1/1986 | von Resch | 49/209 X |
| 4,702,514 | 10/1987 | Perry | 49/209 X |

*Primary Examiner*—Rodney M. Lindsey
*Assistant Examiner*—Jerry Redman
*Attorney, Agent, or Firm*—Townsend and Townsend

[57] ABSTRACT

A sealing mechanism for mounting to one window around a periphery, or the window sash, thereof and being movable to make contact with a surface of another window to create a seal or insulation between the two windows. The sealing mechanism comprises a frame having a first gasket and a second gasket attached on the frame for cooperating with side surfaces on said two windows. A driving mechanism which comprises a rack feed gear and a rack bar movable in a direction substantially perpendicular to the direction of movement of the frame by the feed gear which is provided on one window to convert a linear movement of the rack bar into a backward or forward movement of the frame so as to effect a seal or insulation between an inner side and an outer side defined by the window set by bringing the first gasket in contact with the side surface of said one window and simultaneously bringing the second gasket in contact with the side surface of said another window.

7 Claims, 7 Drawing Sheets

SEALING MECHANISM FOR A WINDOW SET

BACKGROUND OF THE INVENTION

The present invention relates generally to sealing devices four sound or air insulation, such as those between a first and a second are defined by the structure where the sealing devices are mounted. More particularly, the present invention relates to a sealing mechanism for a wndow set in which the sealing mechanism is disposed around one window which is separated from another window, and then is operable to move toward said another window for effectuation of a seal or insulation between the inner and outer sides defined by the window set, i.e., to create an airtight condition for the window set.

Windows or window sets capable of insulating or sealing air and sound on the outside from the inside are available. In one example, the window itself can be pivotally and slidably moved toward or away from the window frame, generally by the guidance of pins and tracks or the like when a substantial force for moving the window is applied. Along the window sash, the window is suitably provided with sealing means, e.g., resilient, compressible rubber material, which cooperates or mates the window frame to produce a seal or insulation effect. In this concentration, it is necessary to have a space sufficient enough to accommodate the window while it is moved away from the window frame.

It is known that a sliding window, although convenient, cannot obtain a tight insulting contact between the window and window frame. To retain the convenience of the sliding-tupe window while making it more weather efficient, e.g., a better seal and more airtight, the invention has proposed a device which is carried by the window so that normal opening and closing operations are not affected, and which can efficiently create a satisfactory insulating seal.

SUMMARY OF THE INVENTION

Accordingly, it is an object of this invention to provide a sealing mechanism for a sliding-type window set which is disposed on one window allowing air to freely flow between the window and the mechanism, and which moves backward and forward to make contact with another window to create a seal between the first window and the sealing mechanism as well as between the sealing mechanism and the second window.

A further object of this invention is to provide a sealing mechanism which is mounted substantially around a window sash and is operable to make contact with another window or window frame, or a planar surface, to create a seal or to insulate therebetween, thereby preventing air flow between the window at which the sealing mechanism is mounted and the object which is in contact with the sealing mechanism.

Another object of this invention is to provide a sealing mechanism which is simple in construction and is easy to operate.

These and additional objects, if not set forth specifically herein, will be readily apparent to those skilled in the art from the detailed description provided hereinbelow, with appropriate reference to the accompanying drawings.

DETAILED DESCRIPTION OF THE PREFERRED EMBODIMENT

Figure 1:
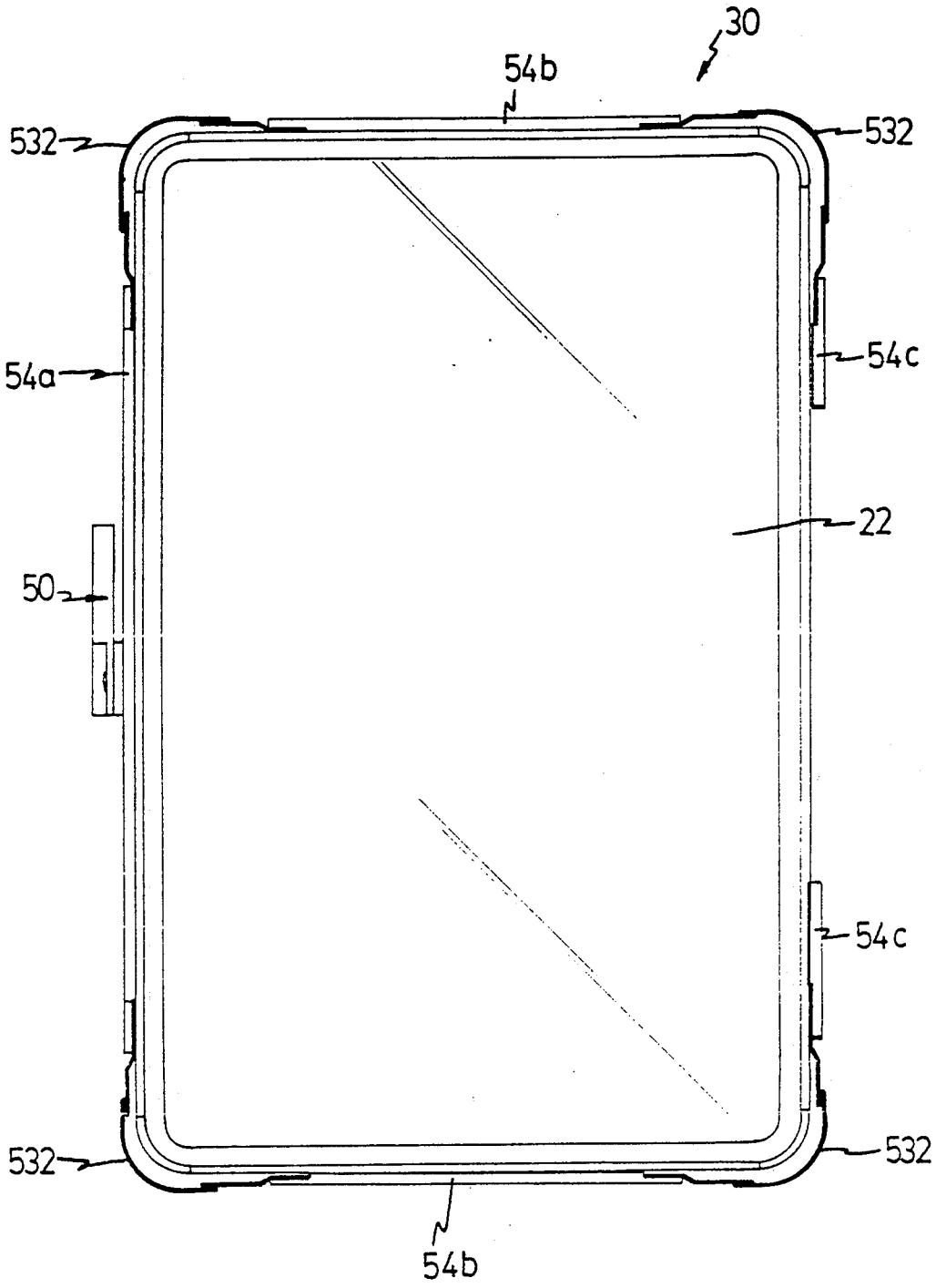
FIG. 1 is a plan view of a sealing mechanism mounted on a window, showing the general structure of the sealing mechanism of the invention.
Figure 6:
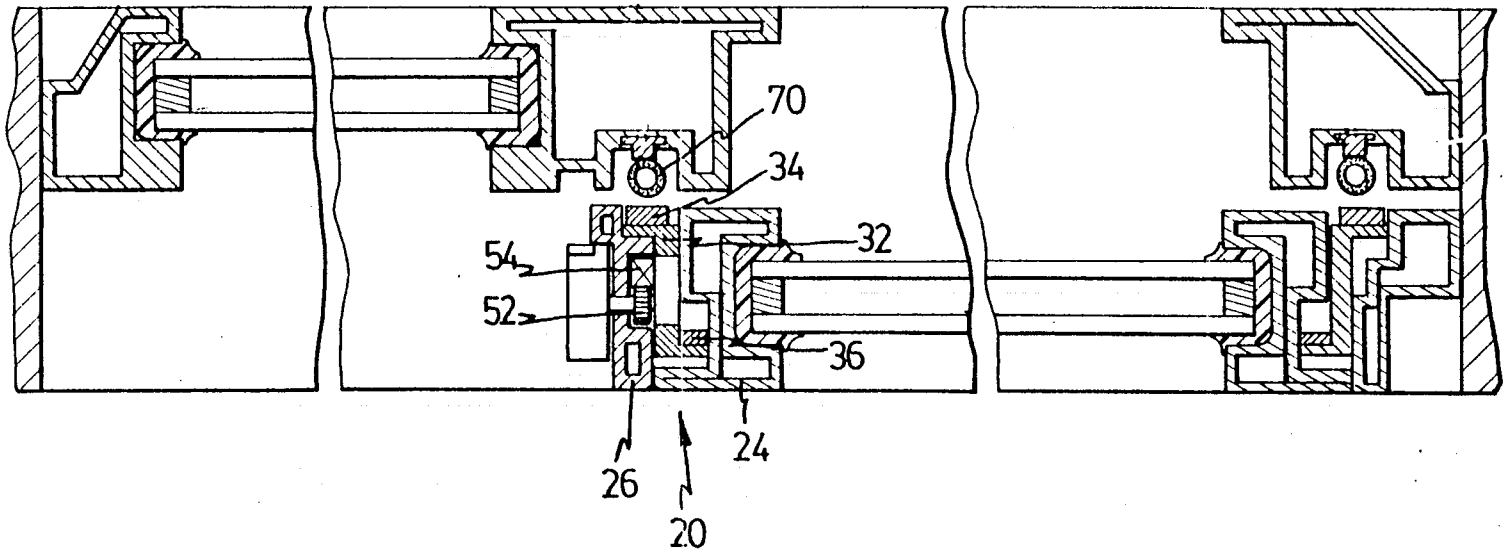
FIG. 6 is a cross-sectional view showing the construction and arrangement of the sealing mechanism and window combination with another window in accordance with the invention.
Figure 7:
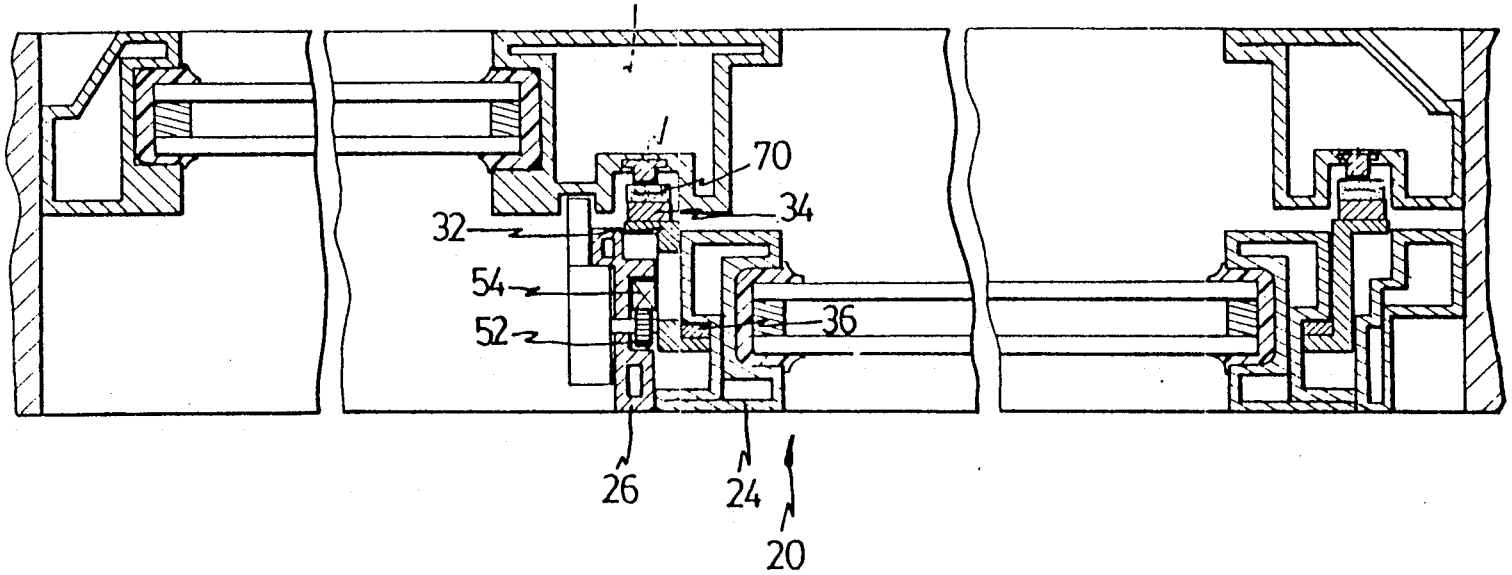
FIG. 7 is a view similar to FIG. 6, but showing the frame of the sealing mechanism of the invention being actuated to effect a seal or to insulate between opposite sides of a window set.

Referring to the drawings, and more particularly to FIGS. 1, 6 and 7, there is shown the sealing mechanism mounted on a window or a window set in accordance with the invention, and the combination is generally designated by reference number 20. In the embodiment shown in FIGS. 6 and 7, it can be seen that the window set on which the sealing mechanism of the invention is mounted is comprised of two windows laterally slidable with respect to each other. The window set is generally disposed on a wall in a known manner so as to define an inner side and an outer side. The sealing mechanism of the invention therefore can be used to create or produce an airtight relationship between the inner and outer sides of the window set.

According to the invention, the sealing mechanism, designated by refernece number 30, basically comprises a frame 32 which encloses a window 22 along its periphery, the window sash 24 of conventional design and structure, and a driving means 50 for actuation of the frame 32 to move in a predetermined direction with respect to the window set. On the frame 32 there are attached a first and a second gaskets 34 and 36 which are intended to cooperate or contact with a respective side surface of each one of the of the two windows to facilitate a seal effect when the frame 32 is actuated to move in the predetermined direction.

Figure 3:
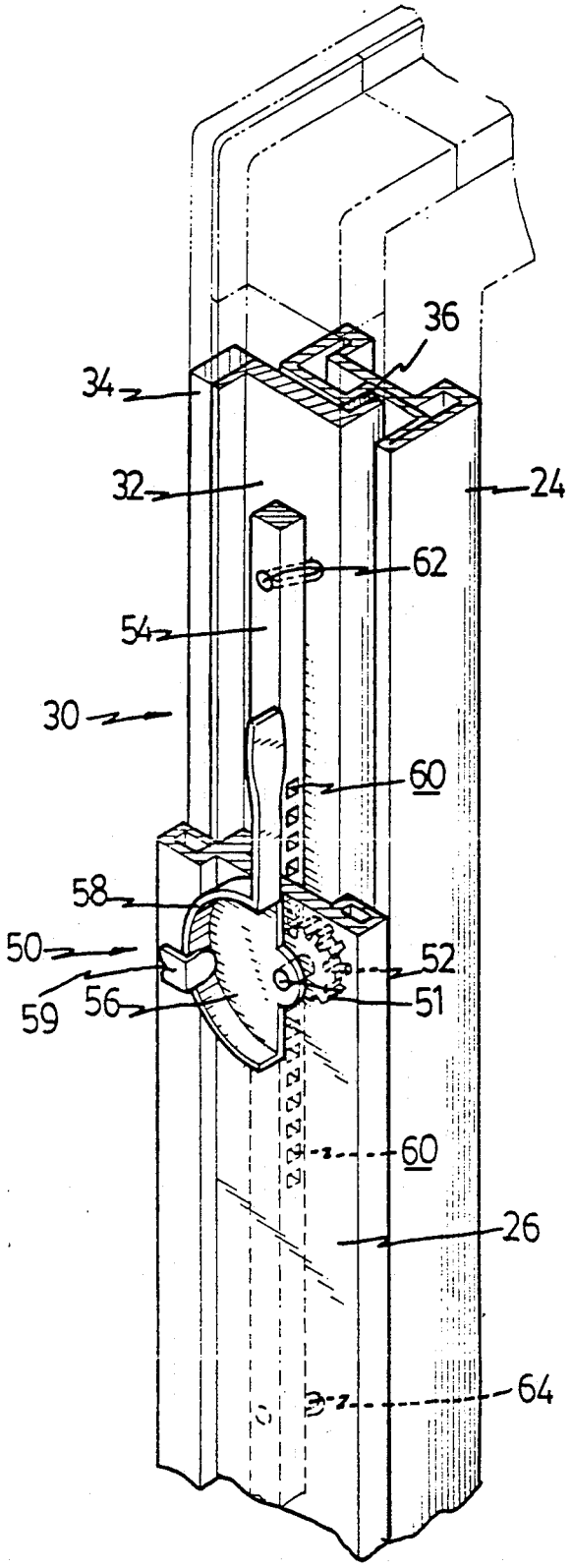
FIG. 3 is a perspective cut-away view, showing the frame and the driving means of the invention.
Figure 4:
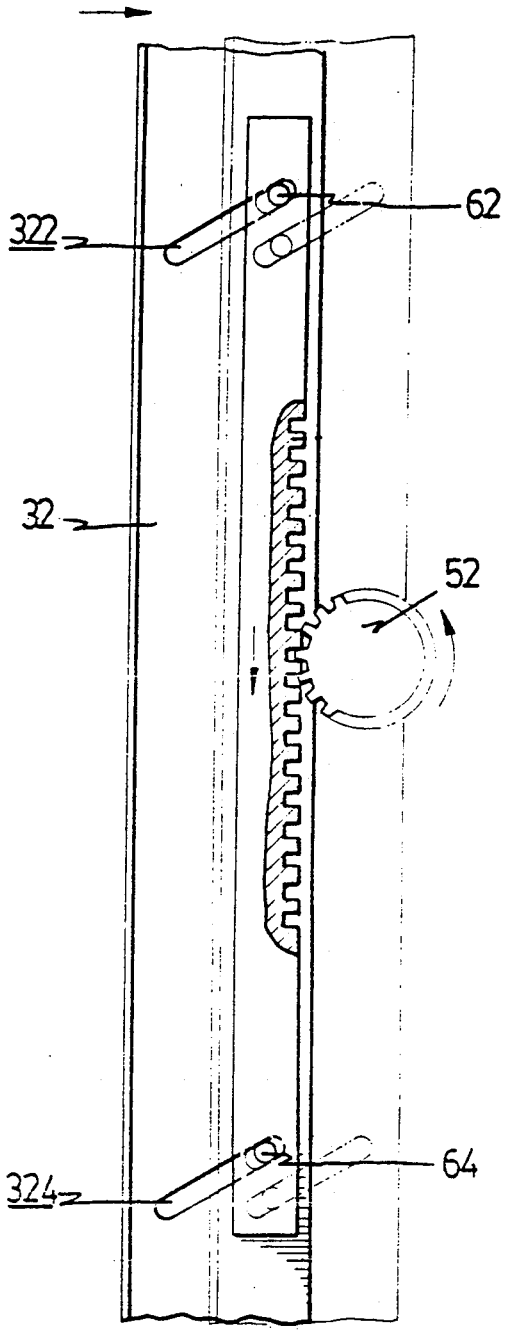
FIG. 4 schematically shows the relationship between the rack bar of the driving means and the frame in accordance with the invention.

FIGS. 3 and 4 show the driving means 50 and its construction and operation with respect to the frame 32. The driving means 50 comprises a rack feed gear 52, and a rack bar 54 that is movable by the rack feed gear 52 in a direction substantially perpendicular to the direction of movement of the frame 32. The rack feed gear 52 is conneced to a locking and driving member 56 through a shaft 51 which is supported on a bracket 26. The rack feed gear 52, the shaft 51 and the member 56 combination is thus rotatably supported by the bracket 26. The locking and driving member 56 has a rim portion 58 which is engageable with a locking hook 59 which may be fixedly disposed on another window. The rack bar 54, which preferably bears against the frame 32, and is also supported by the bracket 26, has a plurality of recesses 60 equally spaced along a portion of its length. Each recess 60 has a shape and size which is enageable with the teeth of the rack feed gear 52 so as to convert a rotational movement of the rack feed gear 52 into a linear movement of the rack bar 54.

FIG. 3 shows that the rack bar 54 further has an upper and a lower pin 62 and 64, which are fixedly provided on the rack bar 54 and the extending from a surface thereof toward the frame 32 to engage with corresponding inclined slots 322 and 324 of the frame 32, respectively, such that the above-described linear movement of the rack bar 54 also results in a movement of the frame 32. As shown in FIG. 4, when the rack feed gear 52 is turned in the direction indicated by the arrow, the rack bar 54 wiil accordingly move in a downward direction as indicated. Since the rack feed gear 52 and the rack bar 54 are kept mutually engaged by the bracket 26 and the rack bar 54 is confined to be movable only in a upward and downward direction, it can be understood that, responsive to the upward and downward movement of the rack bar 54, the frame 32 will be forced to move rightward (as seen in FIG. 4) due to the engagement between the rack bar 54 and the frame 32 through the pins 62, 64 and inclined slots 322, 324. As described above, a backward movement of the frame 32 results in the contact of the gaskets 34, 36 on the frame 32 with the sides of the window sash 24 of one window and another window, thereby creating a seal or insulation between the inner side and outer side of the window set.

Figure 2:
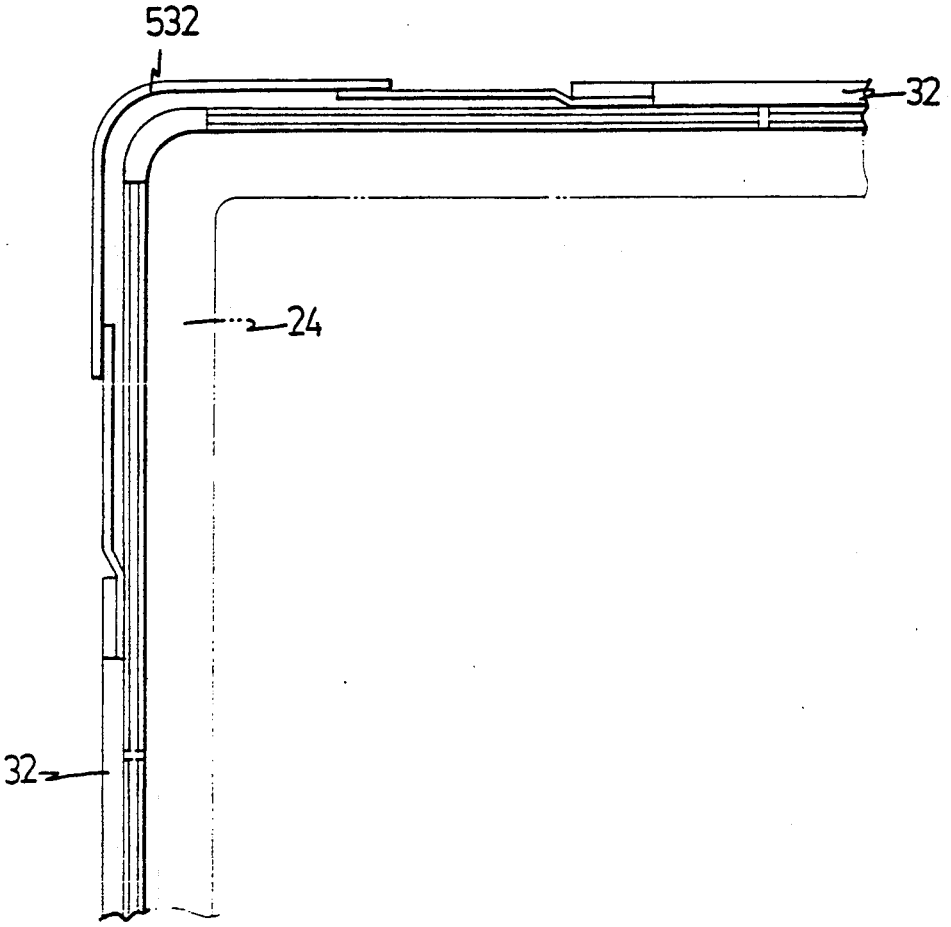
FIG. 2 shows a portion of the sealing mechanism and window combination in an enlarged scale.
Figure 5:
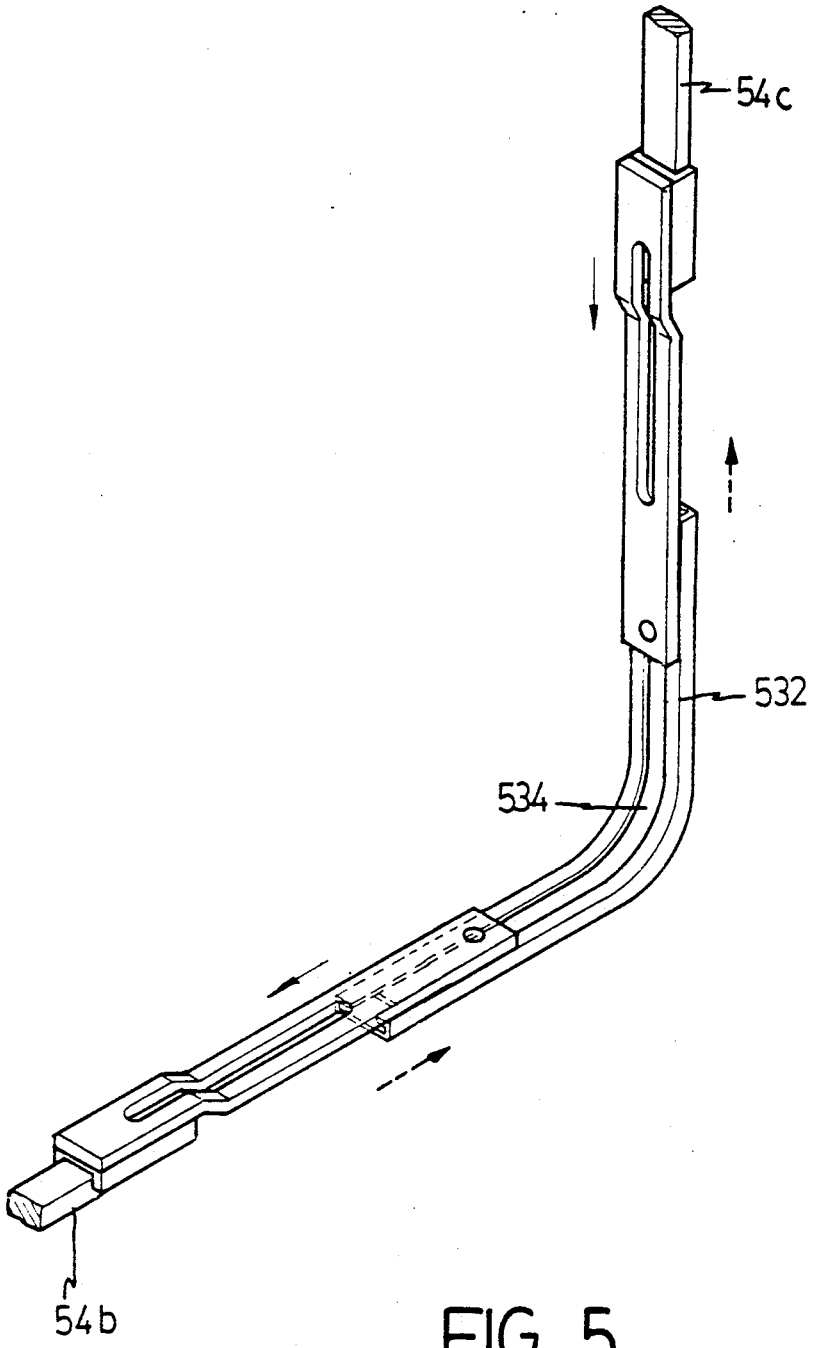
FIG. 5 shows a L-shaped channel element interconnected between two bar segments of the rack bar in accordance with the invention.

FIG. 2 illustrates a portion of the sealing mechanism 30 of FIG. 1 in an enlarged scale. While it is sufficient and preferable to have only one driving means 50, it is desired to have the rack bar 54 comprised of a number of bar segments 54*a*–54*c* extending around a periphery of the frame 32 and linked to each other by a respective corner piece 534 made of a resilient material, as shown in FIG. 5. The corner piece 534 is received within a L-shaped channel element 532, which is fixedly mountable around a corner of the frame 32. As shown in FIG. 1, two adjacent bar segments, e.g., 54*a*–54*b*, 54*b*–54*c*, are slidably connected to the channel element 53 at respective end portions. As clearly shown in FIG. 5 by solid arrows and dotted arrows, two adjacent bar segments (e.g., 54*b* and 54*c*) and one interconnected corner piece 534 are slidable within the stationary L-shaped channel element 532 in either direction. It is noted that, similar to the bar segment seen in FIG. 3, other bar segments have their respective pins, e.g., the two long bar segments 54*b* each have two pins thereon and the two short bar segments 54*c* each may need only one pin thereon, for engaging with corresponding inclined slots provided on the frame 32. In this manner, the rack bar 54, which is substantially C-shaped as seen in FIG. 1, can be moved around the frame 32 either in clockwise or counterclockwise direction in order to force the frame 32 to move forward or backward, or vice versa, as described above. Also, the C-shaped rack bar 54 will provide a balanced actuation force on the frame 32.

To obtain a better seal or insulation effect between the set of windoes, a deformable pipe 70 or the like can be suitable affixed to a side surface or window sash of another window in order to be beared by the second gasket 34 on the frame 32 when the frame 32 is actuated to move toward said another window.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as shall fall within the scope of the appended claims.

I claim:

1. A sealing mechanism used for a window set mounted in a wall, the set including a window having an inner side and an outer side, and a member in opposing relationship to the window, the window and the member defining first and second surfaces defined by the window and the member, respectively, comprising:

a guiding means having a frame arranged about the window along a periphery thereof and being moveablé backwards and forwards relative and substantially perpedicular to the window, said guiding means comprising a first gasket attached to said frame for cooperating with the first sealing surface of said window and a second gasket attached to said frame for cooperating with the second sealing surface of the member; and a driving means comprising a rack feed gear and a rack bar that is movable in a direction substantially perpendicular to the direction of the movement of said frame of said guiding means by said rack feed gear, said driving means converting a linear movement of said rack bar into said backward or forward movement of said guiding means so as to block a communication between said inner side and said outer side of the window by moving said first gasket into contact with said first sealing surface of said window and simultaneously by moving said second gasket into contact with said second sealing surface of said member.

2. The sealing mechanism as claimed in claim 1, wherein said rack bar has a plurality of recesses spaced along a portion of its length with each recess being engageable with teeth of said rack feed gear so that a rotating movement of said rack feed gear about its axis results in a linear movement of said rack bar.

3. The sealing mechanism as claimed in claim 1, further comprising a deformable pipe affixed to said second sealing surface in order to bear against said second gasket on said frame when said frame is actuated to move toward said member.

4. The sealing mechanism as claimed in claim 1, wherein at least two pins are fixedly provided on said rack bar and extending toward said frame of said guiding means each for engaging with a corresponding inclined slot of said frame so that said linear movement of said rack bar results in said backward or forward movement of said frame of said guiding means.

5. The sealing mechanism as claimed in claim 4, wherein said rack bar extends around a periphery of said frame and comprises a plurality of bar segments linked to each other, and wherein at least one pin is fixedly provided on said bar segment and extending toward said frame of said guiding means for engaging with a corresponding inclined slot provided on said fame so that movement of said rack bar with respect to said frame results in said backward or forward movement of said frame of said guiding means.

6. The sealing mechanism as claimed in claim 5, wherein a respective corner piece is provided to link two adjacent bar segments at respective end portions thereof, said corner piece being slidably received within a L-shaped channel element which is fixedly diposed at a corner of said frame of said guiding means.

7. The sealing mechanism is claimed in claim 5, wherein said rack bar extends past corners of the frame and has a substantially C-shaped, longitudinal configuration.

* * * * *